United States Patent [19]

Kutik et al.

[11] 4,146,155

[45] Mar. 27, 1979

[54] CONTINUOUS TRIGGER ACTIVATED PUMPING SYSTEM

[75] Inventors: Louis F. Kutik, Ft. Lauderdale; Howard E. Cecil, Miami, both of Fla.

[73] Assignee: Security Plastics Inc., Miami Lakes, Fla.

[21] Appl. No.: 851,277

[22] Filed: Nov. 14, 1977

[51] Int. Cl.[2] ..... B05B 11/02

[52] U.S. Cl. ..... 222/109; 222/189; 222/385; 239/331; 417/541

[58] Field of Search ..... 222/108, 109, 189, 257, 222/259, 260, 318, 321, 340, 341, 380, 381, 383–385, 442, 332; 417/313, 541; 239/120, 121, 331, 333

[56] References Cited

U.S. PATENT DOCUMENTS

| | | | |
|---|---|---|---|
| 2,974,880 | 3/1961 | Stewart et al. | 239/493 |
| 3,228,571 | 1/1966 | O'Donnell et al. | 222/321 |
| 3,908,870 | 9/1975 | Nozawa et al. | 222/321 |
| 3,927,834 | 12/1975 | Tada | 239/359 |
| 3,967,762 | 7/1976 | Machon | 222/321 |
| 4,022,354 | 5/1977 | Kotuby | 222/321 |
| 4,079,865 | 3/1978 | Kutik | 417/541 X |
| 4,081,111 | 3/1978 | Sandow | 222/321 X |

FOREIGN PATENT DOCUMENTS

| | | | |
|---|---|---|---|
| 648460 | 1/1951 | United Kingdom | 239/333 |

*Primary Examiner*—Robert J. Spar
*Assistant Examiner*—Fred A. Silverberg
*Attorney, Agent, or Firm*—Oltman and Flynn

[57] ABSTRACT

A pumping system is disclosed in which a storage compartment formed by a spring-loaded piston and cylinder assembly cooperates with a trigger actuated, spring loaded piston and cylinder assembly to store some product during a pressure stroke and discharge that product on a subsequent intake stroke to maintain a stream or spray issuing from the system. In a preferred embodiment, the trigger is part of a lever so constructed as to apply to the trigger actuated piston and cylinder assembly a force which is greater than the force applied to the trigger by the finger of a person. The lever projects outwardly beyond the outlet orifice of the pumping system and forms a ramp and opening for returning drips from the outlet orifice to the trigger actuated piston and cylinder assembly and ultimately to the container. The storage compartment preferably includes a strainer which strains product flowing through the storage compartment in order to inhibit clogging of the outlet orifice of the pumping system. A vent structure is also provided which includes a guide for guiding the trigger actuated piston and cylinder assembly to prevent distortion of a resilient seal of the vent structure.

15 Claims, 8 Drawing Figures

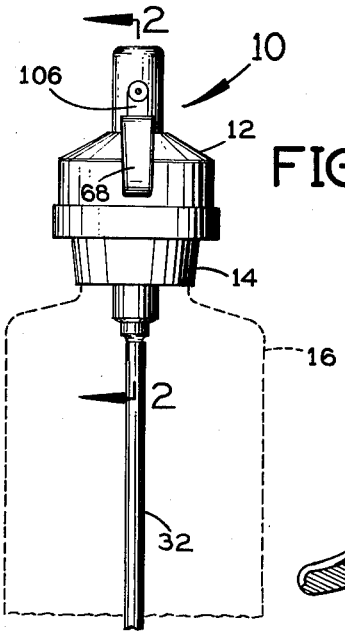
FIG. 1
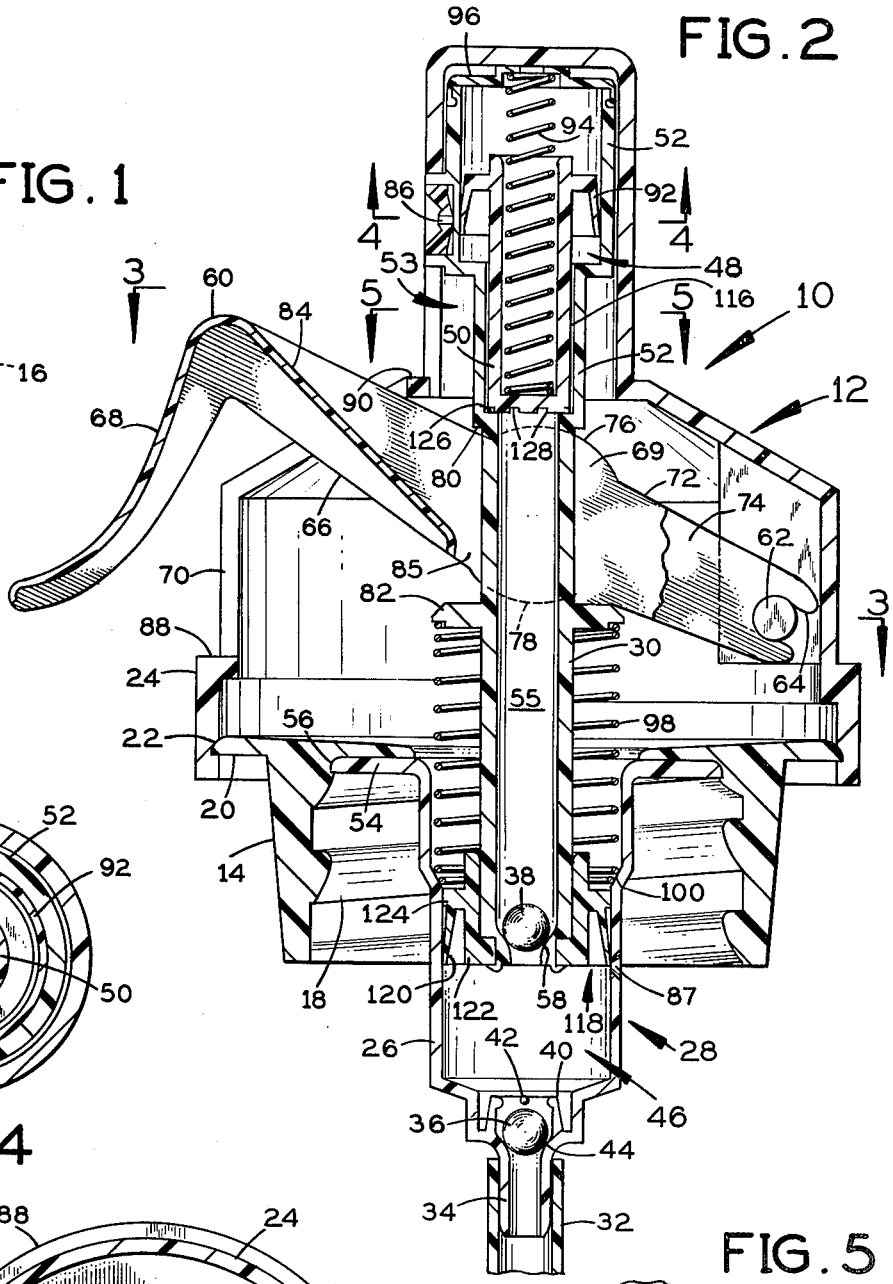
FIG. 2
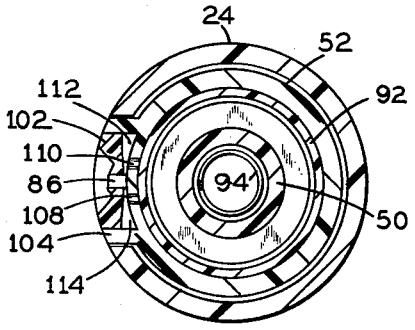
FIG. 4
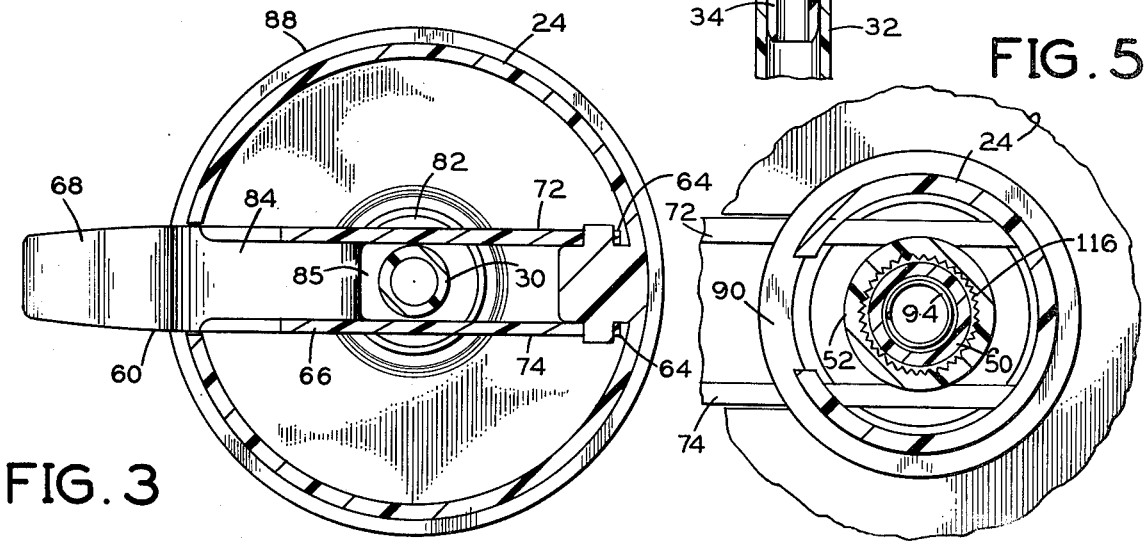
FIG. 3
FIG. 5

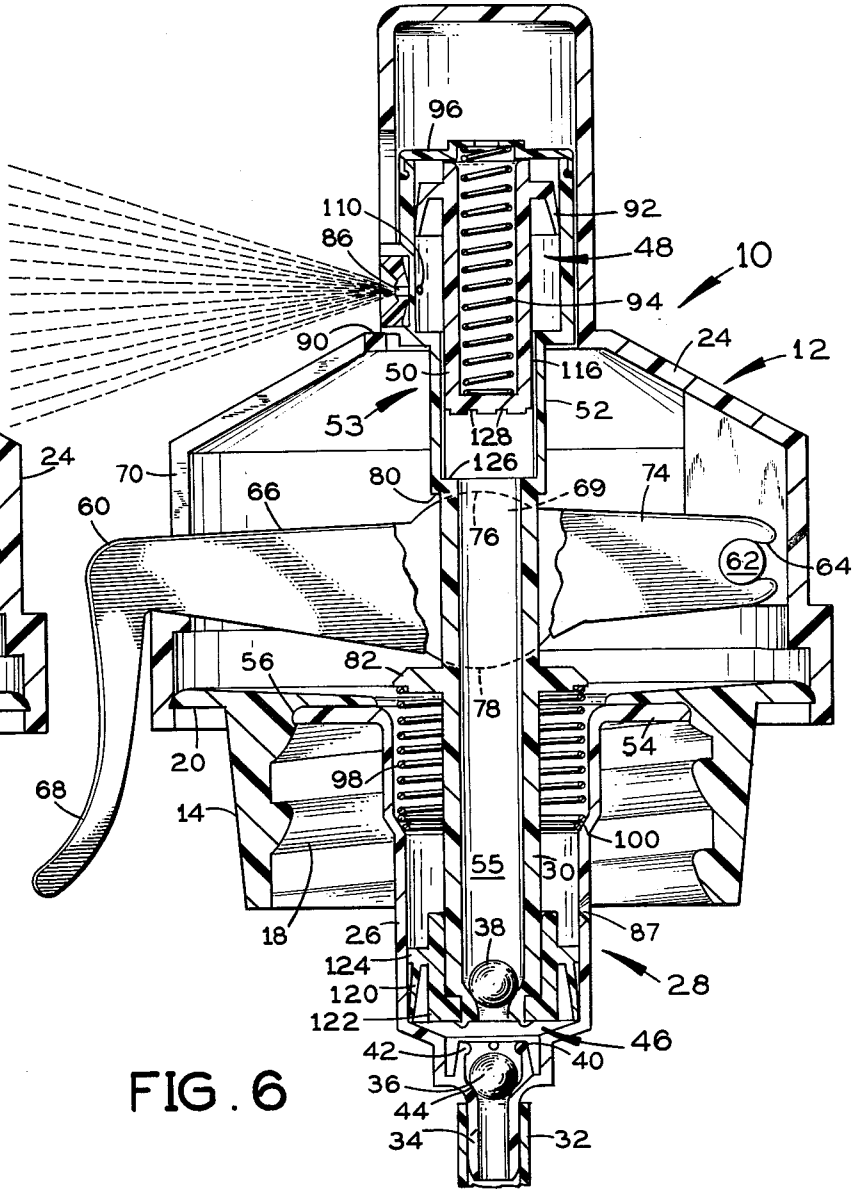
FIG. 6
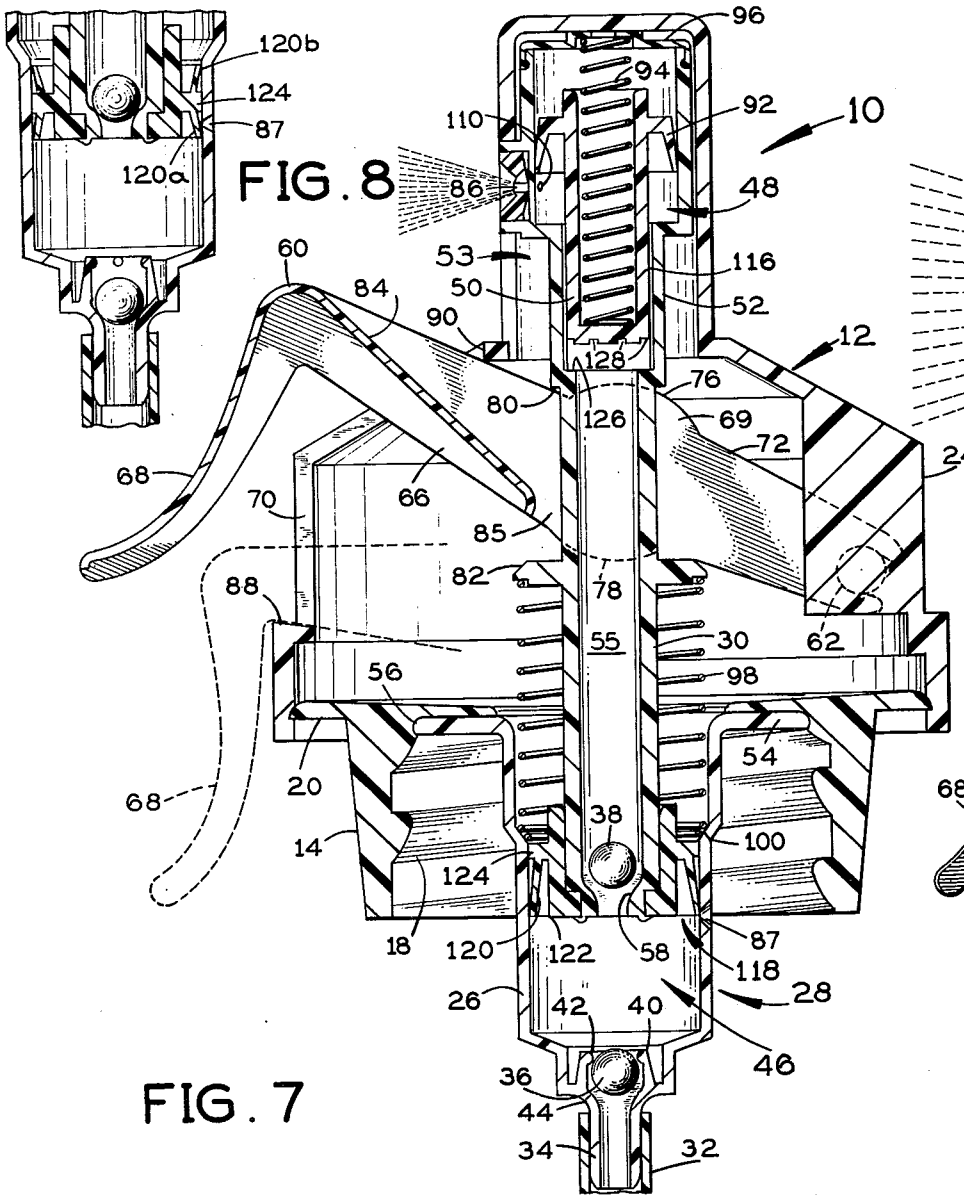
FIG. 7
FIG. 8

CONTINUOUS TRIGGER ACTIVATED PUMPING SYSTEM

RELATED PATENT APPLICATIONS

This application is related to U.S. patent application Ser. No. 659,227 filed on Feb. 19, 1976 by Louis F. Kutik, now U.S. Pat. No. 4,079,865, and U.S. patent application Ser. No. 795,090 filed on May 9, 1977 by Louis F. Kutik and Howard E. Cecil, now U.S. Pat. No. 4,109,832.

BACKGROUND OF THE INVENTION

The aforementioned patent applications disclose and claim a pumping system in which a quantity of pressurized product is stored in a storage compartment during a pressurizing stroke and discharged through an outlet orifice during a succeeding intake stroke to maintain a stream or spray issuing from the system. The present invention is directed to the provision of a trigger device which is especially advantageous for actuation of such a pumping system. A pumping system of the type disclosed in the copending applications may also include a novel strainer and a novel vent means in accordance with this invention.

SUMMARY OF THE INVENTION

The invention provides a trigger device for actuation of a pumping system as described above and in the copending applications including a lever pivoted to one side of a housing at one end, engaging a piston between its ends, and having a trigger arm at the other end projecting from the opposite side of the housing, such that the force applied to the piston is greater than the force applied to the trigger arm by the finger of an operator. The lever forms an inwardly sloping ramp for returning drips from an outlet orifice to the container from which product is pumped. The pumping system preferably includes a strainer in the storage compartment for straining foreign matter from the product to prevent clogging of the outlet, and a special vent structure including a guide which prevents distortion of a resilient seal included in the vent structure.

Accordingly, it is an object of the present invention to provide a pumping system in which a part of the pressurized product is stored to be discharged automatically during an intake stroke of the operating mechanism with a trigger type lever for actuating the operating mechanism and for increasing the force applied to the lever by the finger of an operator.

Another object of the invention is to return drips from an outlet orifice of the pumping system to the container via an inwardly sloping actuating lever which extends outwardly under the outlet orifice.

A further object of the invention is to incorporate in a storage compartment of the pumping system a strainer which removes foreign matter from the product as it passes through the storage compartment to prevent clogging of the outlet orifice.

Another object of the invention is to guide a piston of the pumping system in a manner such as to prevent distortion of a seal for the piston.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 is an elevational view of a pumping system in accordance with a preferred embodiment of the invention with a container being shown in dashed lines;

FIG. 2 is a vertical sectional view of the pumping system of FIG. 1 taken along line 2—2 of FIG. 1;

FIG. 3 is a cross-sectional view taken through a lever of the pumping system along line 3—3 of FIG. 2;

FIG. 4 is a cross-sectional view taken through a storage compartment of the system along line 4—4 of FIG. 2;

FIG. 5 is another cross-sectional view taken along line 5—5 of FIG. 2;

FIG. 6 is a vertical sectional view showing the condition of the pumping system when the actuating lever is depressed;

FIG. 7 is a vertical sectional view similar to FIG. 6 but showing the condition of the pumping system when the actuating lever rises; and FIG. 8 is a fragmentary sectional view showing a modification of a vent structure of the pumping system.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

The pumping system 10 includes a housing 12 having a mounting ring 14 as part thereof to be affixed to the container 16. The mounting ring 14 has internal threads 18 for engaging threads on the neck of the container 16, but it will be understood that the ring 14 could have a snap fit on the container's neck. The mounting ring 14 has a lip 20 which slidably engages in a groove 22 of the shell 24 of the housing 12 so that the shell 24 can be rotated relative to the mounting ring 14. The housing 12 also includes a cylinder 26 of a piston and cylinder device generally designated 28 and also including a piston 30. The piston and cylinder device 28 serves to withdraw a quantity of product from the container through a dip tube 32 on an intake stroke and to pressurize that quantity of product during a pressurizing stroke of the piston 30. The cylinder 26 serves as part of the piston and cylinder device 28 and also as part of the housing 12. The cylinder 26 has a reduced tip 34 for attachment to the dip tube 32.

The piston and cylinder device 28 also includes two check valves 36 and 38. The check valve 36 is located within a small enclosure 40 provided with projections 42 which allow the valve 36 to rise from its seat 44 while still retaining the valve above the tip 34. The check valve 38 is located at the outlet of a pressurizing compartment 46 and also serves as the inlet for a storage compartment 48 which also includes an accumulator piston 50 and a cylinder 52 forming a second piston and cylinder device 53. The storage compartment 48 communicates with the check valve 38 through a space 55 inside piston 30, and the piston 30 is constructed as a cylinder which may be an integral part of the cylinder 52.

The first cylinder 26 has a lip 54 which is snapped into a groove 56 in the mounting ring 14. The check valve 38 is normally seated on a valve seat 58, but it can rise from that seat during the pressurizing stroke of the piston 30 to admit product through the space 55 into the storage compartment 48. The space 55 may be considered as an extension of the storage compartment 48. The product in the container 16 is normally a liquid and it flows past the check valve 36 into the pressurizing compartment on an intake stroke of the piston 30.

The piston 30 is actuated by a lever 60. A pivot means including a pin 62 and snap acting recesses 64 in the lever 60 pivotally connect the right end of the lever 60 to the shell 24 (part of the housing 12) at the right side of the piston 30. The pin and recesses may be reversed.

The pin 62 may be formed integrally with the shell 24, and each recess 64 is formed in the right end of the lever 60 so that the lever can be snapped on and off the pin 62 for assembly purposes.

The lever includes a first arm 66 which has an intermediate portion 69 engaging the piston 30 for operating the piston by reciprocating movement of the lever. The lever 60 includes a second arm 68 depending from the first arm on the left side of the piston 30 to provide a finger actuated trigger outside the housing 12. The lever 60 extends through a slot 70 formed in the shell 24, and the slot 70 is long enough in the vertical direction to permit the lever 60 to reciprocate. The intermediate portion 69 applies to the piston 30 a force which is greater than the force applied to the trigger arm 68.

The intermediate portion 69 of the lever includes spaced portions 72 and 74 straddling the piston 30. The portions 72 and 74 have rounded edges at 76 and 78 which respectively engage projections 80 and 82 on the piston 30 for raising and lowering the piston as the lever 60 reciprocates. The shell 24 can be turned by pushing the lever sideways.

The arm 66 of the lever 60 slants upwardly and outwardly from the pivot pin 62, and the trigger arm 68 of the lever 60 slants downwardly and outwardly from the outward end of the arm 66, such that the trigger arm 68 may be actuated by downwardly and inwardly directed force supplied thereto by the finger of a person who is operating the pumping system when the pumping system is in an upright position as shown in FIG. 1. The trigger arm 68 is sufficiently short so that only one finger of the operator may be used to actuate the lever 60. The trigger arm 68 preferably does not have sufficient room to receive two or more fingers of the operator. In a particular embodiment, 5 pounds of force applied to the trigger with one finger will build up to about 50 psi in the pump. If three fingers could pull on the trigger, 5 pounds per finger would result in 150 psi in the pump which could burst it.

The arm 66 includes a downwardly and inwardly sloping ramp 84 located under a restricted outlet orifice 86 of the pumping system. The ramp extends between portions 72 and 74. The arm 66 extends outwardly from the piston 30 well beyond the restricted outlet orifice 86 such that any drips coming from the orifice 86 will be received by the ramp 84 and returned downward through space 85 into the cylinder 26. The trigger arm 68 is located well outward beyond the orifice 86 so that drips from the orifice do not drip on the fingers of the person operating the pumping system. From the cylinder 26, the drips are returned to the container 16 through a vent opening 87 when the opening 87 is unblocked as will be explained.

The lever 60 is shown in a depressed condition in FIG. 6 as it would appear just after a pressurizing stroke of the piston 30. It may be seen that a shelf 88 on the shell 24 at the bottom of slot 70 forms a stop for limiting the downward movement of the lever 60. The lever 60 is shown in a raised rest position as it would appear just at the end of an intake stroke of the piston 30 in FIG. 7. A bridge 90 forms a stop for limiting the upward movement of the lever 60, and the bridge 90 is part of the shell 24 located at the upper end of the slot 70.

The accumulator piston 50 has a resilient skirt 92 which sealingly engages the wall of the storage cylinder 52 and acts to control the flow of product to the outlet orifice 86. The accumulator piston 50 is biased downwardly by a spring 94 which has a lower end engaging the bottom of the piston 50 and an upper end engaging a cap 96 at the top of the storage cylinder 52. The piston 30 is urged upwardly by a spring 98 which has a lower end engaging a shelf 100 formed in the cylinder 26 and an upper end engaging the projection 82 on the piston 30.

As shown in FIG. 4, the restricted outlet orifice 86 is formed in a spray button 102 which is inserted in a circular projection 104 that rides in a slot 106 (FIG. 1) formed in the upper part of the shell 24. The projection 104 projects outwardly from the storage cylinder 52. A pair of horizontally spaced outlet openings 108 and 110 communicate from the storage compartment 48 through channels 112 and 114 with the restricted outlet orifice 86. The restricted outlet orifice is located at the outlet of the storage compartment and completely controls the rate of product discharge therethrough so as to allow only a portion of the pressurized product to be dispensed from the pump during the pressurizing stroke, when pumping relatively rapidly, the remainder of the product being stored in the storage compartment to be dispensed during a subsequent intake stroke of the piston 30 by contraction of the storage compartment to maintain the stream or spray from the orifice when the pressurizing pump is receiving product on its intake stroke.

The action of the accumulator piston 50 is shown in FIGS. 6 and 7. After a pressurizing stroke of the lever 60, the accumulator piston 50 is in a raised position as shown in FIG. 6. Until the accumulator piston engages the cap 96, the spring 94 determines the pressure under which the product is stored in the storage compartment 48. This pressure can be increased after the accumulator piston 50 has engaged the cap 96. During the intake stroke of the lever 60, the accumulator piston 50 moves downwardly to maintain the stream or spray issuing from the orifice 86 so that the stream or spray is relatively continuous when pumping rapidly. At the end of the intake stroke, the condition of the lever 60 and the accumulator piston 50 is shown in FIG. 7. The accumulator piston 50 has descended until it is almost ready to close the outlet openings 108 and 110. In the rest condition of the accumulator piston 50 shown in FIG. 2, the skirt 92 of the accumulator piston closes the outlet openings 108 and 110 to completely shut off flow of product to the restricted outlet orifice 86. The outlet opening or openings could be located at the center of the storage chamber to be opened and closed by an accumulator piston below them.

As the product flows through the storage compartment 48, it is strained by a strainer 116 located at the inside surface of the storage cylinder 52. The preferred strainer is shown particularly in FIG. 5 where it may be seen that there are strainer grooves 116 formed on the inside surface of the cylinder 52. These grooves have a cross-sectional area smaller than the cross-sectional area of the restricted outlet orifice 86 so that they will catch particles of other foreign matter in the product flowing through the storage compartment and prevent that foreign matter from clogging the outlet orifice 86. If any one of the grooves 116 becomes clogged, there are other grooves which will act to continue the straining action. By locating the strainer just ahead of the outlet orifice 86, the straining action is maximized so as to catch any foreign particles which may enter the product flow within the pump.

The pumping system also includes a vent means designated generally 118. The vent means includes the vent opening 87 formed in the cylinder 26 and also includes a seal 120 in the form of a circular skirt resiliently engaging the inside of the cylinder 26 and attached to the piston 30. The sealing skirt 120 depends from a ring 122 which is affixed by riveting to the bottom of the piston 30 such that the ring and the sealing skirt 120 may be made of a softer material than the piston 30. However, it will be understood that it would be possible to make the sealing skirt 120 an integral part of the piston 30. The vent means also includes a guide 124 in the form of an interrupted ring slidably engageable with the inside surface of the cylinder 26 for guiding the movement of the piston 30 without distorting the sealing skirt 120. This guide 124 may be relatively rigid so as to properly center the piston 30 while allowing the seal 120 to function properly.

As shown in FIG. 8, the vent means may be modified to include two sealing skirts **120*a* and 120*b* as well as a guide 124. The skirts 120*a* and 120*b*** project in opposite directions.

When the lever 60 is in its raised position, the sealing skirt 120 acts to block the vent opening 87. When the lever 60 is depressed as shown in FIG. 6, the interior of the container 16 is vented to the atmosphere through the vent opening 87, thus allowing the pressure inside the container to equalize with atmospheric pressure. At this time any drips which have flowed from the ramp 84 into the cylinder 26 can return to the container 16 through the vent opening 87.

Where the bottom of the accumulator piston 50 engages the offset 126, slots 128 are formed in the bottom of the accumulator piston to allow product to flow past the piston. It may be noted that it may be possible to provide very slight clearance between the piston 50 and the inside surface of the cylinder 52 so as to perform the straining function without making grooves in the wall of the cylinder 52 or the piston 50. This clearance should be smaller than the diameter of the outlet orifice 86. Even if the grooves 116 are formed in the cylinder 52 as shown, the straining function could be performed by only a few grooves rather than a completely knurled surface as shown. Thus, the strainer constitutes a narrow passage just ahead of the outlet orifice.

The cylinder 26 has a very slight upward and outward taper (say ½% of the diameter of cylinder 26) so that pressure on the skirt 120 increases slightly as the skirt descends, and pressure on the skirt 120 is at a minimum in the rest condition of the system. Thus the skirt 120 does not take a set.

In some pumps, the inside diameter of at least the lowest turn of the spring 98 will be smaller than the outside diameter of the ring 124 to retain the spring on the ring 124 when the pump is being assembled. The reduced diameter of cylinder 100 will still hold the outside diameter of spring 98.

In some pumps it may not be essential to make the trigger such that it will receive only one finger of the operator.

Having thus described our invention, we claim:

1. In a pumping system for use with a container for product and a dip tube to dispense product from the container through the dip tube, said pumping system including:

a housing with a mounting means to be affixed to the container;

a manually actuated pressurizing pump including first and second check valves and a first spring-loaded piston and cylinder assembly for withdrawing a quantity of product from the container through said dip tube and said first check valve during an intake stroke and for pressurizing said quantity of product during a pressurizing stroke, said first cylinder also acting as part of said housing for attachment to the dip tube;

storage compartment means including a second spring-loaded piston and cylinder assembly expandable for storing under a pressure determined by said second spring-loaded assembly, a quantity of pressurized product received through said second check valve from said pressurizing pump; and a restricted outlet orifice;

said storage compartment means being functionally located with said restricted outlet orifice at its outlet and said second check valve at its inlet from said pressurizing pump;

said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke;

said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

the improvement comprising:

a lever including a first arm having an intermediate portion in said housing engaging said first piston and movable to operate said first piston, and a second arm depending from said first arm on one side of said first piston to provide a finger-actuated trigger outside said housing;

said lever and said housing having pivot means pivotally connecting said lever to said housing on the side of said first piston opposite said one side;

whereby the force applied to said first piston during operation by said intermediate portion of said lever is greater than the actuating force applied to said trigger;

said first arm of said lever extending outwardly from said piston under said restricted outlet orifice so that said trigger is located outwardly of said piston and outwardly beyond said restricted outlet orifice;

and said first arm forming a downwardly and inwardly sloping ramp means under said orifice for returning drips from said orifice to said container.

2. The pumping system as claimed in claim 1 further including:

strainer means including grooves formed on the inside of said second cylinder for straining product flowing through said storage compartment means to said orifice for inhibiting clogging of said orifice;

said grooves having an area smaller than the area of said orifice.

3. The pumping system as claimed in claim 1 further including:

vent means for venting said container to the atmosphere including;

means forming a vent opening in said first cylinder;

resilient seal means on said first piston for blocking said opening in the rest position of said first piston and unblocking said opening during the pressurizing stroke of said first piston; and relatively rigid guide means on said first piston slidable in said first cylinder to guide the movement of said first piston during said intake and pressure strokes.

4. The pumping system as claimed in claim 3 in which said first cylinder has a slight upward and outward taper.

5. The pumping system as claimed in claim 1 in which:

said first arm is inclined upwardly from said pivot means; and said second arm is inclined downwardly and outwardly from said first arm.

6. The pumping system as claimed in claim 5 in which:

said second arm has a length sufficient to receive only one finger of a person.

7. The pumping system as claimed in claim 6 and further including:

strainer means including grooves formed on the inside of said second cylinder for straining product flowing through said storage compartment means to said orifice for inhibiting clogging of said orifice;

said grooves having an area smaller than the area of said orifice.

8. In a pumping system for use with a container for product and a dip tube to dispense product from the container through the dip tube, said pumping system including:

a housing;

a manually actuated pressurizing pump including first and second check valves and a first spring-loaded piston and cylinder assembly for withdrawing a quantity of product from the container through said dip tube and said first check valve during an intake stroke and for pressurizing said quantity of product during a pressurizing stroke;

storage compartment means including a second spring-loaded piston and cylinder assembly expandable for storing under a pressure determined by said second spring-loaded assembly, a quantity of pressurized product received through said second check valve from said pressurizing pump;

a restricted outlet orifice;

said storage compartment means being functionally located with said restricted outlet orifice at its outlet and said second check valve at its inlet from said pressurizing pump;

said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke;

said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

the improvement comprising:

an actuating lever;

pivot means pivotally affixing one end of said actuating lever to said housing at one side of said first piston;

means on an intermediate portion of said lever engaging said first piston and said second cylinder for operating said first piston and second cylinder by reciprocating movement of said lever;

said lever including at the other end thereof trigger means outside said housing on the opposite side of said piston for actuation by a finger of a person;

said trigger means being located farther from said pivot means than said intermediate portion;

said actuating lever including a first arm extending upwardly and outwardly from said pivot means;

and a second arm forming said trigger means and extending downwardly and outwardly from the outward end of said first arm;

whereby said lever is constructed to apply to said first piston a force which is greater than the force applied to the trigger means during operating by the finger of the person.

9. The pumping system as claimed in claim 8 and further including:

vent means for venting said container to the atmosphere including;

means forming a vent opening in said first cylinder;

resilient seal means on said first piston for blocking said opening in the rest position of said first piston and unblocking said opening during the pressurizing stroke of said first piston; and relatively rigid guide means on said first piston slidable in said first cylinder to guide the movement of said first piston during said intake and pressure strokes.

10. The pumping system as claimed in claim 8 in which:

said pivot means includes a pin and snap acting recess means acting between said lever and said housing.

11. The pumping system as claimed in claim 8 in which:

said first arm includes spaced portions straddling said first piston and forming said intermediate means for operating said first piston.

12. The pumping system as claimed in claim 11 in which:

said spaced portions have rounded edges engaging said first piston and said second cylinder.

13. The pumping system as claimed in claim 11 in which:

said first arm includes a portion forming a downwardly and inwardly sloping ramp under said orifice for returning drips to said container.

14. In a pumping system for dispensing product from a container through a dip tube out of an orifice, the pumping system including a housing, the combination therewith of:

a lever including a first arm having an intermediate portion in said housing, and a second arm depending from one end of said first arm outside the housing to provide a finger-actuated trigger outside the housing;

said lever and said housing having pivot means pivotally connecting the other end of said lever to said housing;

said first arm of said lever extending outwardly from said housing under said orifice;

and said first arm forming a downwardly and inwardly sloping ramp means under said orifice for returning drips from the orifice to the container.

15. The pumping system as claimed in claim 14 in which:

said second arm has a length sufficient to receive only one finger of a person.

* * * * *